US011753855B2

(12) United States Patent
Mensch

(10) Patent No.: US 11,753,855 B2
(45) Date of Patent: Sep. 12, 2023

(54) CLOSING SYSTEM

(71) Applicant: WITTE AUTOMOTIVE GMBH, Velbert (DE)

(72) Inventor: Reinaldo Mensch, Wuppertal (DE)

(73) Assignee: WITTE AUTOMOTIVE GMBH, Velbert (DE)

( * ) Notice: Subject to any disclaimer, the term of this patent is extended or adjusted under 35 U.S.C. 154(b) by 355 days.

(21) Appl. No.: 16/960,016

(22) PCT Filed: Dec. 21, 2018

(86) PCT No.: PCT/EP2018/086701
§ 371 (c)(1),
(2) Date: Jul. 2, 2020

(87) PCT Pub. No.: WO2019/137809
PCT Pub. Date: Jul. 18, 2019

(65) Prior Publication Data

US 2021/0062556 A1 Mar. 4, 2021

(30) Foreign Application Priority Data

Jan. 9, 2018 (DE) ..... 102018100301.3

(51) Int. Cl.

| | |
|---|---|
| ***E05B 81/06*** | (2014.01) |
| ***E05B 81/16*** | (2014.01) |
| ***E05B 79/22*** | (2014.01) |
| *E05B 79/20* | (2014.01) |
| *E05B 81/34* | (2014.01) |
| *E05B 85/10* | (2014.01) |

(52) U.S. Cl.
CPC ..... *E05B 81/06* (2013.01); *E05B 79/22* (2013.01); *E05B 81/16* (2013.01); *E05B 79/20* (2013.01); *E05B 81/34* (2013.01); *E05B 85/107* (2013.01)

(58) Field of Classification Search
CPC ..... E05B 81/06; E05B 81/14; E05B 81/16; E05B 81/25; E05B 81/28; E05B 81/30;
(Continued)

(56) References Cited

U.S. PATENT DOCUMENTS 7,434,854 B2 * 10/2008 Fujimatsu ..... E05B 81/25 292/201
9,926,727 B2 * 3/2018 Kouzuma ..... E05B 81/34
(Continued)

FOREIGN PATENT DOCUMENTS

DE 19702420 A1 7/1998
DE 10350328 A1 5/2004
(Continued)

OTHER PUBLICATIONS

German Patent and Trade Mark Office, Search Report for German patent application No. 102018100301.3, dated Nov. 23, 2018.
(Continued)

*Primary Examiner* — Kristina R Fulton
*Assistant Examiner* — Noah Horowitz
(74) *Attorney, Agent, or Firm* — Wiggin and Dana LLP

(57) ABSTRACT

The invention relates to a closing system for a door, in particular a side door of a motor vehicle, comprising a door lock, an inner door handle for opening the door lock, an outer door handle for opening the door lock, an actuator unit and a control mechanism, which is driven by the actuator unit, for implementing different closing states of the closing system.

19 Claims, 8 Drawing Sheets

(58) Field of Classification Search
CPC ..... E05B 81/34; E05B 81/42; E05B 81/46; E05B 85/10; E05B 85/107; E05B 85/12; E05B 79/00; E05B 79/10; E05B 79/20; E05B 79/22; E05B 81/20; E05B 81/21; Y10T 292/1047; Y10T 292/1048; Y10T 292/1055; Y10T 292/1056; Y10T 292/1057; Y10T 292/1059; Y10T 292/1076; Y10T 292/1077; Y10T 292/1078; Y10T 292/1079; Y10T 292/108; Y10T 292/1082; Y10T 292/57; Y10S 292/23; Y10S 292/25; Y10S 292/27; Y10S 292/64
See application file for complete search history.

(56) References Cited

U.S. PATENT DOCUMENTS

| | | | | |
|---|---|---|---|---|
| 10,563,437 | B2 * | 2/2020 | Bartels | B60Q 1/2669 |
| 10,648,201 | B2 * | 5/2020 | Cumbo | E05B 77/06 |
| 10,808,436 | B2 * | 10/2020 | Cuddihy | E05B 83/24 |
| 10,920,464 | B2 * | 2/2021 | Im | E05B 81/14 |
| 11,118,380 | B2 * | 9/2021 | Balakrishna | E05B 79/22 |
| 11,332,963 | B2 * | 5/2022 | Karlein | E05B 85/103 |
| 2021/0156179 | A1 * | 5/2021 | Savant | E05B 17/0054 |

FOREIGN PATENT DOCUMENTS

| | | | | |
|---|---|---|---|---|
| DE | 102004014550 | A1 | 10/2005 | |
| DE | 102007049900 | A1 | 4/2008 | |
| DE | 102010035083 | A1 | 2/2012 | |
| DE | 102011050471 | A1 | 11/2012 | |
| DE | 102014107986 | A1 | 12/2015 | |
| DE | 102015011468 | A1 | 3/2017 | |
| DE | 102015122490 | B4 | 11/2017 | |
| EP | 2659076 | B1 | 11/2013 | |
| EP | 3203002 | A1 * | 8/2017 | E05B 77/12 |

OTHER PUBLICATIONS

European Patent Office, Search Report for International patent application No. PCT/EP2018/086701, dated Apr. 12, 2019.

* cited by examiner

CLOSING SYSTEM

CROSS-REFERENCE TO RELATED APPLICATION

The present application claims priority to German Patent Application No. 102018100301.3 that was filed Jan. 9, 2018, the contents of which is hereby incorporated by reference in its entirety.

TECHNICAL FIELD

The present invention relates to a closing system for a door, in particular a side door of a motor vehicle, comprising a door lock, an inner door handle for opening the door lock, an outer door handle for opening the door lock and an actuator unit.

BACKGROUND

Such closing systems are generally known and usually have at least two actuator units, namely one for retracting and extending the outer door handle, another for servo opening of the door lock when the inner door handle and outer door handle are actuated, and, if appropriate, additional actuator units for establishing different closing states, such as a so-called safe state in which both the outer door handle and the inner door handle are mechanically separated from the door lock, a central locked state or a child lock state. Such closing systems are not only expensive due to their numerous actuator units, but also susceptible to faults.

BRIEF SUMMARY OF THE INVENTION

The object of the invention is therefore to provide a closing system which is characterized by enhanced economy and reliability.

The object is achieved by a closing system with the features of claim 1 and in particular in that a control mechanism driven by the actuator unit is provided for implementing different closing states of the closing system.

The invention is based on the general idea of providing, as it were, a switching logic through the control mechanism, which allows a plurality of different switching states to be switched by means of a single actuator unit, more precisely a plurality of different closing states of the closing system. Since only a single actuator unit is required to set all the closing states of the closing system thanks to the control mechanism provided according to the invention, additional actuator units can be dispensed with. In particular, no actuator unit is required in the door lock itself. As a result, the closing system as a whole cannot only be manufactured and offered more cost-effectively, but it is also less susceptible to faults, since it only comprises one actuator unit which could potentially become defective.

Another object of the invention is the control mechanism itself, in particular a control mechanism for a closing system, which comprises an actuator unit, a door lock, an inner door handle and an outer door handle. Yet another object of the invention is a clutch for a closing system, which comprises an actuator unit, a door lock, an inner door handle and an outer door handle.

Advantageous embodiments of the invention can be found in the dependent claims, the description and the drawings.

At least three, preferably at least four and particularly preferably at least five different closing states can be established by means of the actuator unit and control mechanism, including the "outer door handle retracted/extended" "safe," "locked," "unlocked," "door lock opened" and "child lock" states.

In particular, with the aid of the control mechanism driven by the actuator unit, the inner door handle and the outer door handle can be mechanically decoupled from the door lock in order to implement a so-called safe state; and/or the outer door handle only can be mechanically decoupled from the door lock in order to implement a locked state; and/or the inner door handle only can be mechanically decoupled from the door lock in order to implement a child lock function; and/or the door lock can be opened, i.e. a servo opening function can be implemented; and/or the inner door handle and/or the outer door handle can be mechanically coupled to the door lock in order to enable the door lock to be opened by manually actuating the inner door handle or the outer door handle and thereby creating mechanical redundancy; and/or the outer door handle can be extended for actuation by a vehicle user, for example when the outer door handle is in the safe state and/or a locked state of the closing system is retracted and, for example, is flush with an outer panel of the door; and/or a closing aid integrated into the door lock can be activated.

The actuator unit can comprise, for example, an electric actuator unit and in particular an electric motor.

As mentioned, the door lock can be opened mechanically by manual actuation of the inner door handle and/or the outer door handle if the inner door handle or the outer door handle is coupled to the door lock. Not only can a servo opening of the door lock be provided, but a mechanical opening of the door lock is also possible in order to create mechanical redundancy.

Furthermore, a closing cylinder can be provided, by means of which the outer door handle can be coupled to the control mechanism or decoupled from the control mechanism. This advantageously creates mechanical redundancy in the event that the actuator unit should fail.

According to a further embodiment, the closing system comprises a clutch, by means of which the inner door handle can be mechanically coupled to or decoupled from the door lock. The clutch is advantageously suitable for implementing a child lock function and a safe function and forms a separate object of the invention.

The clutch can be arranged in the region of the door lock or can be integrated into the door lock for a particularly compact design.

The clutch can advantageously be controlled by the control mechanism.

The control mechanism and the clutch are preferably connected by a first mechanical actuating means, in particular a Bowden cable.

In addition, the inner door handle and the clutch can be connected by a second mechanical actuating means, in particular a Bowden cable.

According to a further embodiment, a control unit for controlling the control mechanism is provided. The control unit can be arranged in the region of the actuator unit or can be integrated into it. In principle, however, it is also conceivable to arrange the control unit away from the actuator unit and/or to integrate it into a vehicle control system.

The control unit advantageously has an interface for wireless communication with a mobile terminal, in particular a smartphone. For example, the control unit can be controlled by means of an installed app, in particular on a mobile terminal such as a smartphone. Alternatively or additionally, the control unit can be controlled by a remote key, whether directly or indirectly via a vehicle control system.

According to a further embodiment, the control mechanism forms a first drive chain for actuating the door lock, i.e. for setting different locking states of the door lock, and a second drive chain for retracting/extending and engaging/disengaging the outer door handle.

For example, the control mechanism can have a first control element which can be driven by the actuator unit and a second control element which can be driven by the actuator unit. The first and second control elements can preferably be driven synchronously.

According to one embodiment, the first control element interacts with an external actuating element, in particular an external actuating lever, which is connected to the clutch via an actuating means, in particular a Bowden cable. For example, the first control element can be a control disk, which interacts with the external actuating element in particular via a first slider.

According to a further embodiment, the external actuating element can be brought into three defined positions by the first control element, in particular a safe position in which both the outer door handle and the inner door handle are mechanically decoupled from the door lock, a ready position and an open position in which a pawl of the door lock is lifted.

According to yet a further embodiment, the second control element interacts with a transmission element connected to the outer door handle, in particular an outer door handle lever. The second control element can also be a control disk which interacts with the transmission element, in particular via a second slider.

The transmission element can preferably be rotated by the second control element from a first position, in which the outer door handle is retracted, to a second position, in which the outer door handle is extended. The outer door handle itself can be rotatable, pivotable and/or translationally retractable or extendable.

The transmission element can be rotated into the second position while the external actuating element is in its ready position.

According to a further embodiment, the second control element interacts with an unlocking element, in particular an unlocking lever, which in turn interacts with the transmission element. With the aid of the unlocking element, the transmission element can be brought from a locked position, in which a rotation of the external actuating element by the transmission element is impossible, into an unlocked position, in which the external actuating element can be rotated by the transmission element.

The transmission element advantageously assumes its unlocked position when it is rotated into its second position. The transmission element and the unlocking element are preferably rotated synchronously.

According to a further embodiment, the clutch comprises a release wheel which can be engaged indirectly by rotating in an opening direction, for example via a release lever, or directly with a pawl of the door lock in order to lift the pawl.

A first actuating means connecting the clutch and the control mechanism is advantageously attached to the release wheel in such a way that a pull on the first actuating means exerted by the control mechanism causes the release wheel to rotate in the opening direction.

To implement an optional child lock function, a second actuating means, which connects the clutch and the inner door handle, is preferably attached to the release wheel with a freewheel.

Advantageously, a latch is rotatably mounted on the release wheel, through which the freewheel of the second actuating means can be canceled.

A rotation of the latch to cancel the freewheel is preferably brought about by a rotation of the release wheel triggered by the first actuating means, in particular by the latch running onto a control cam relative to which the release wheel is rotated. To implement a child lock function, the control cam can be adjusted relative to the release wheel. The child lock can be implemented both mechanically and electronically.

BRIEF DESCRIPTION OF THE DRAWINGS

The invention is described below purely by way of example using a possible embodiment with reference to the accompanying drawings. In the drawings.

DETAILED DESCRIPTION OF THE INVENTION

Figure 1:
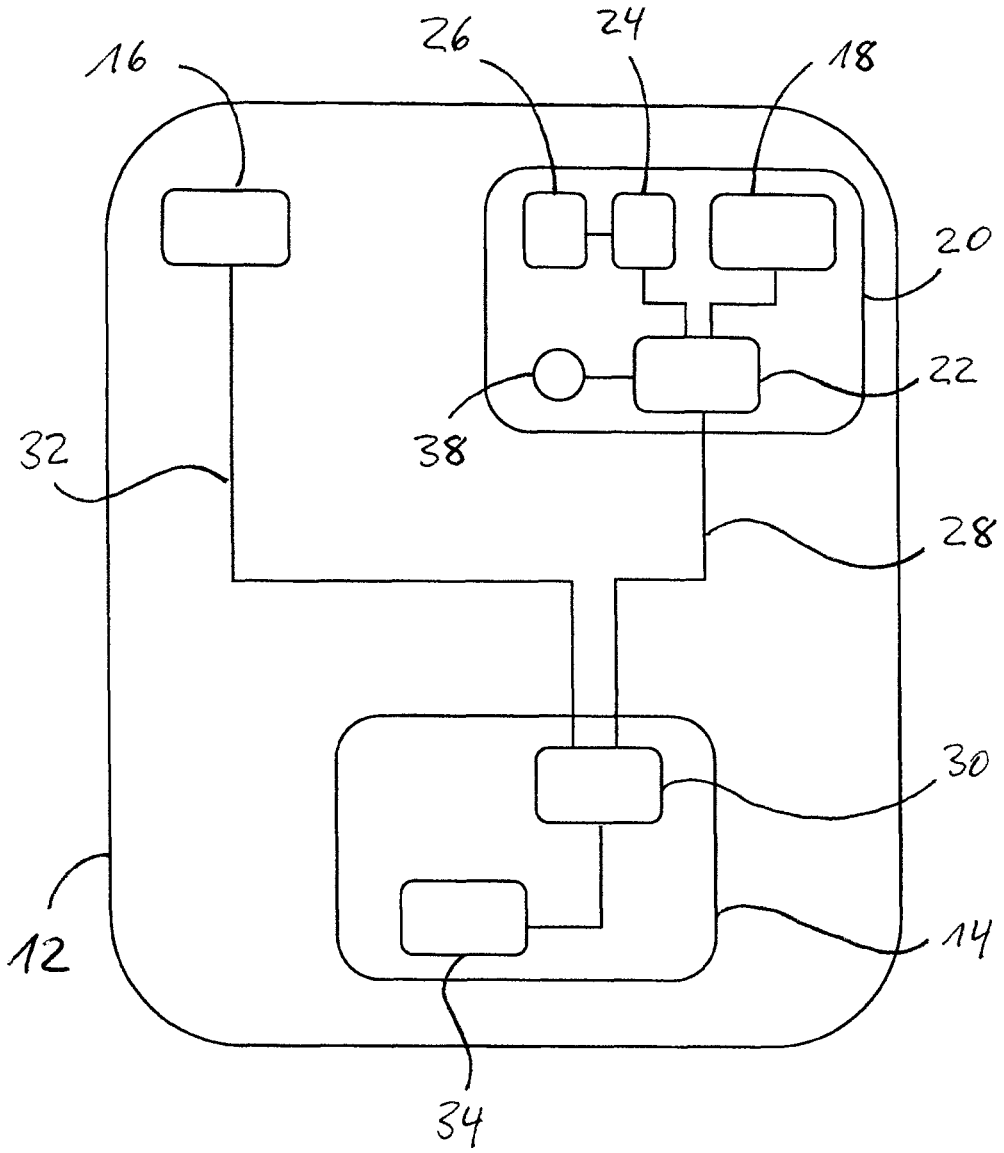
FIG. 1 shows a schematic representation of a closing system according to the invention.
Figure 2A:
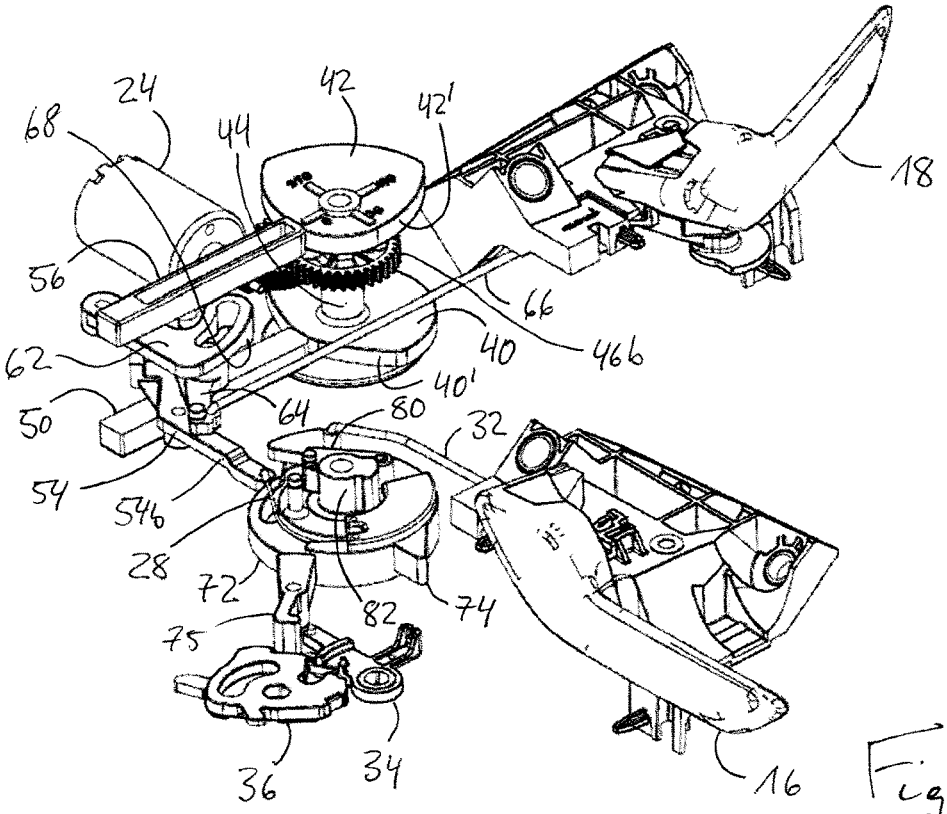
FIG. 2A shows a perspective view of relevant components of the closing system of FIG. 1 in a safe state.
Figure 2B:
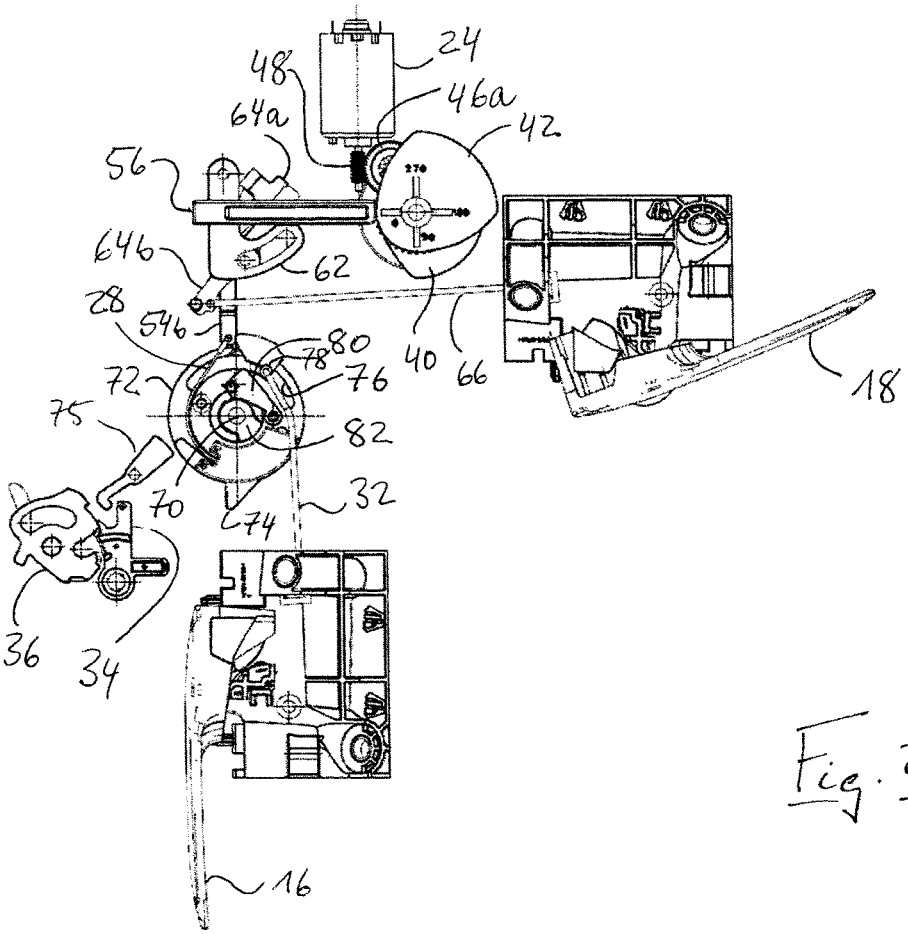
FIG. 2B shows a top view of the components of FIG. 2A.

In FIG. 1, a closing system according to the invention for a door 12, here a side door of a motor vehicle, is represented schematically. The closing system comprises a door lock 14, an inner door handle 16 for opening the door lock 14 and an outer door handle 18 for opening the door lock 14. The outer door handle 18 is mounted in a conventional manner on a bearing bracket 20 and can be moved between a retracted position in which the outer door handle 18 is not accessible from the outside and, for example, is flush with an outer panel of the door 12, and an extended position in which the outer door handle 18 can be operated manually by a vehicle user.

The bearing bracket 20 also carries a control mechanism 22 and an actuator unit 24, here in the form of an electric motor, for driving the control mechanism 22. To control the actuator unit 24, a control unit 26 is provided, which is connected to microswitches and/or sensors of the closing system (not shown here) and also has an interface (also not shown) for wireless communication with a mobile terminal, in particular a smartphone, whereby the control unit 26 and thus ultimately the closing system as a whole can be controlled wirelessly by means of the mobile terminal and in particular an app installed on a smartphone. Alternatively or additionally, the control unit 26 can communicate directly or indirectly, for example via a vehicle control system, with a remote key. In the present embodiment, the control unit 26 is arranged on the bearing bracket 20, but it could just as well be arranged elsewhere and/or be integrated into a vehicle control system, as long as there is a connection to the actuator unit 24.

The control mechanism 22 is connected to the door lock 14 by a first Bowden cable 28, more precisely to a clutch 30 arranged in the door lock 14. The inner door handle 16 is also connected to the clutch 30 of the door lock 14 by a second Bowden cable 32. By appropriately actuating the clutch 30, a pawl 34 of the door lock 14 can be lifted in order to enable the rotation of a rotary latch 36 of the door lock 14 and thus ultimately the opening of the door lock 14.

In the present embodiment, the bearing bracket 20 also carries a closing cylinder 38, by means of which the outer door handle 18 can be coupled to the control mechanism 22 or can be decoupled from the control mechanism in such a way that if the actuator unit 24 fails, the door lock 14 can be operated manually. In principle, the closing cylinder 38 can also be dispensed with.

The control mechanism 22 is used to implement different closing states of the closing system. Thus, not only can the door lock 14 be opened electrically by the control mechanism 22 driven by the actuator unit 24, but also, for example, the retracted outer door handle 18 can be extended for a manual opening of the door lock 14; the inner door handle 16 and the outer door handle 18 can be decoupled from the door lock in order to establish a so-called safe state of the closing system; the inner door handle 16 and the outer door handle 18 can be coupled to the door lock 14 to unlock the door lock 14; the outer door handle 18 only can be decoupled from the door lock 14 to establish a locked state; the inner door handle 16 only can be decoupled from the door lock 14 to implement a child lock; and/or a closing aid (not shown) can be activated.

As shown in greater detail in FIGS. 2 to 8, the control mechanism 22 comprises a first control disk 40, which is in the lower part of the drawings, and a second control disk 42, which is in the upper part of the drawings. The control disks 40, 42 are rotatably mounted on a common shaft 44, axially spaced apart from one another. A worm gear transmission with two gear wheels 46*a*, 46*b* sits between the control disks 40, 42. One gear wheel 46*a* engages with a worm 48 which is seated on an output shaft of the actuator unit 24, while the other gear wheel 46*b* is arranged on the shaft 44 in a rotationally fixed manner.

A control contour 40' of the first control disk 40, here an outer circumferential surface of the control disk 40, engages with one end of a first slider 50, which is mounted in a movable manner in an orthogonal direction to the shaft 44. In the region of its other end, the first slider 50 forms a first driver pin 52 which interacts with a first arm 54*a* of an external actuating lever 54. The external actuating lever 54 is rotatably mounted about an axis parallel to the shaft 44. A first end of the first Bowden cable 28 is attached to a second arm 54*b* of the external actuating lever 54.

Above the first slider 50 there is a second slider 56 which can be displaced parallel to the first slider 50, one end of which engages with a control contour 42' of the second control disk 42, which is also formed here by an outer surface of the second control disk 42. The second slider 56 forms a second and third driver pin. The second driver pin interacts with an unlocking lever 62. The third driver pin interacts with a first arm 64*a* of an outer door handle lever 64, the second arm 64*b* of which is connected to the outer door handle 18 via a push rod 66.

The unlocking lever 62 and the outer door handle lever 64 are each rotatably mounted about an axis which extends parallel to the shaft 44. In addition, the outer door handle lever 64 can be moved from a passive plane in which the outer door handle lever 64 can rotate without coming into contact with the external actuating lever 54 into an axially spaced active plane in which the first arm 64*a* of the outer door handle lever 64 can engage with the first arm 54*a* of the external actuating lever 54 in order to rotate the external actuating lever 54 and to exert tension on the first Bowden cable 28. The unlocking lever 62 is arranged above the outer door handle lever 64 and has on its underside facing the outer door handle lever 64 a ramp 68 which, when the unlocking lever 62 is rotated, runs onto the outer door handle lever 64 and moves it from the passive plane into the active plane and thus from a locked position into an unlocked position.

As already mentioned, a second end of the first Bowden cable 28 is connected to the clutch 30 located in the door lock 14. The clutch 30 comprises a release wheel 72 which can be rotated about an axis of rotation 70 and from which a projection 74 protrudes radially outwards, which can be engaged with a release lever 75 by rotating the release wheel 72 in an opening direction, clockwise in FIG. 2B, through which the pawl 34 can be lifted to open the door lock 14. The first Bowden cable 28 is fixed on the release wheel 72 in such a way that a pull on the first Bowden cable 28 exerted by the external actuating lever 54 causes the release wheel 72 to rotate in the opening direction.

The second Bowden cable 32 leading to the inner door handle 16 is, however, attached to the release wheel 72 with a freewheel. For this purpose, the release wheel 72 forms a guide link 76 which extends in a part-circle around the axis of rotation 70 and in which a Bowden cable head 78 located at the end of the second Bowden cable 32 is guided in a movable manner, so that tension can be exerted on the second Bowden cable 32 through the inner door handle 16 without the release wheel 72 being rotated.

To cancel the freewheel, a latch 80 is provided which is rotatably mounted on the release wheel 72 in such a way that it can be brought from an idle position, in which it lies completely radially within the guide link 76, into an active position, in which it extends at least partially over the guide link 76 and prevents the Bowden cable head 78 of the second Bowden cable 32 from moving along the guide link 76, so that a pull exerted by the inner door handle 16 on the second Bowden cable 32 via the latch 80 causes the release wheel 72 to rotate in the opening direction.

To rotate the latch 80 from the idle position into the active position, a control cam 82 is provided, which is arranged in a central bore of the release wheel 72. The control cam 82 is fixed relative to the release wheel 72, so that rotation of the release wheel 72 caused by pulling on the first Bowden cable 28 causes the release wheel 72 to rotate relative to the control cam 82, whereby the latch 80 normally runs onto the control cam 82 and is deflected into its active position. To implement a child lock function, the control cam 82 can be adjusted relative to the release wheel 72 in such a way that the latch 80 is not deflected when the release wheel 72 is rotated, and thus the freewheel of the second Bowden cable 32 is not canceled, whereby the inner door handle 16 remains decoupled from the door lock 14 and the door lock 14 cannot be opened by the inner door handle 16.

The functioning of the closing system is described below.

The starting point is a so-called safe state of the closing system (FIG. 2), in which both the outer door handle 18 and the inner door handle 16 are mechanically decoupled from the door lock 14, namely in that the second Bowden cable 32 leading to the inner door handle 16 is in freewheel on the release wheel 72 of the coupling 30 and the outer door handle 18 is not only retracted, but in addition the outer door handle lever 64 lies in its passive plane and consequently cannot be engaged with the external actuating lever 54. The position of the control disks 40, 42 defines an angle of rotation of 0° in this safe state, and the first slider 50 and the external actuating lever 54 accordingly assume safe positions, while the second slider 56, the unlocking lever 62 and the outer door handle lever 64 are each in a locked position.

Figure 3A:
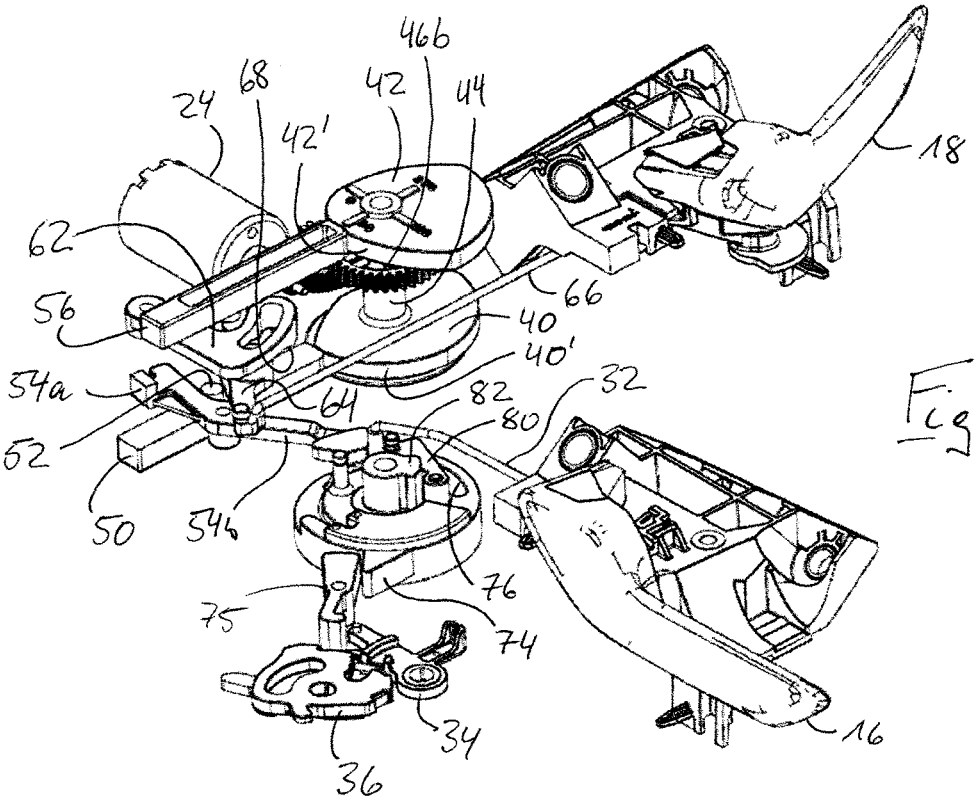
FIG. 3A shows a perspective view of relevant components of the closing system of FIG. 1 in a locked state.
Figure 3B:
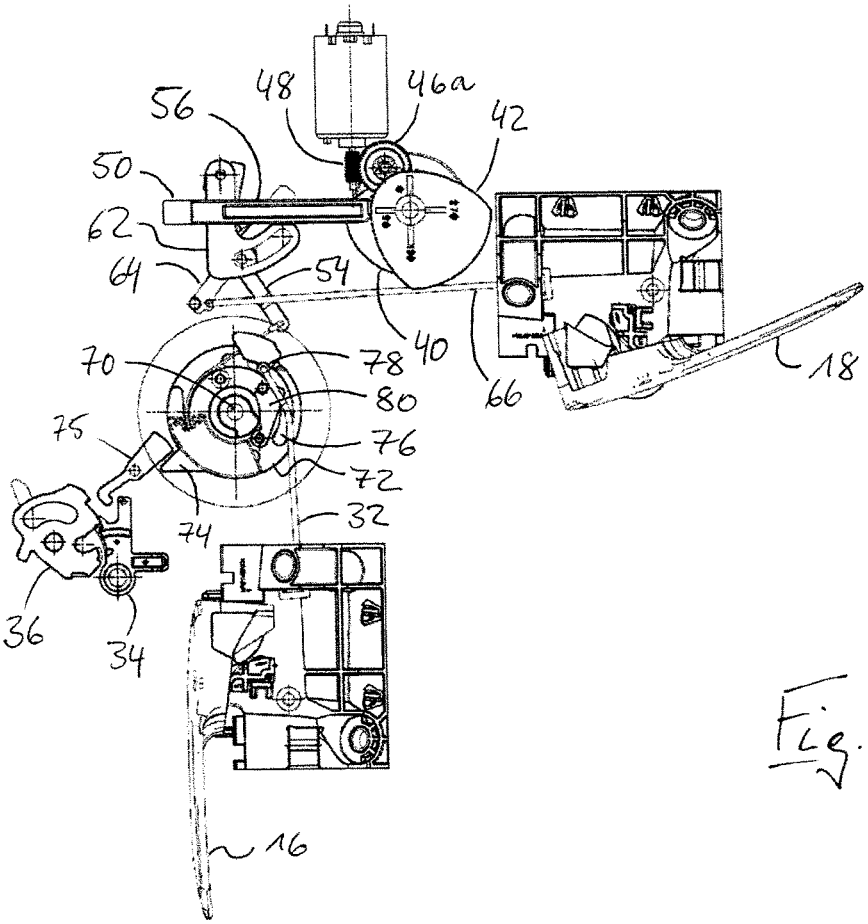
FIG. 3B shows a top view of the components of FIG. 3A.

While the vehicle is moving, the vehicle door 12 is usually automatically locked, which, although it allows the door lock 14 to be opened from the inside, i.e. by actuating the inner door handle 16, makes it impossible to open the door lock 14 from the outside. This state of the closing system is referred to here as the locked state. To establish the locked state, the control disks 40, 42 are rotated through an angle of 90° from their 0° position by corresponding activation of the actuator unit 24 (FIG. 3).

The control contour 42' of the second control disk 42 is designed in such a way that the second slider 56 is not moved during this rotation from 0° to 90°, so that the unlocking lever 62 and the outer door handle lever 64 each remain in their locked positions.

The control contour 40' of the first control disk 40, on the other hand, is designed in such a way that the first slider 50 is displaced from its safe position into its ready position by the rotation of the first control disk 40 from 0° to 90°. By displacing the first slider 50 into the ready position, the external actuating lever 54 is also rotated into its ready position. The rotation of the external actuating lever 54 in turn causes the release wheel 72 of the clutch 30 to be rotated from an idle position (FIG. 2) to a ready position (FIG. 3) via the first Bowden cable 28, in which the projection 74 of the release wheel 72 lies in the region of a release lever 75 and the latch 80 is lifted in order to cancel the freewheel of the second Bowden cable 32 on the release wheel 72.

Figure 4A:
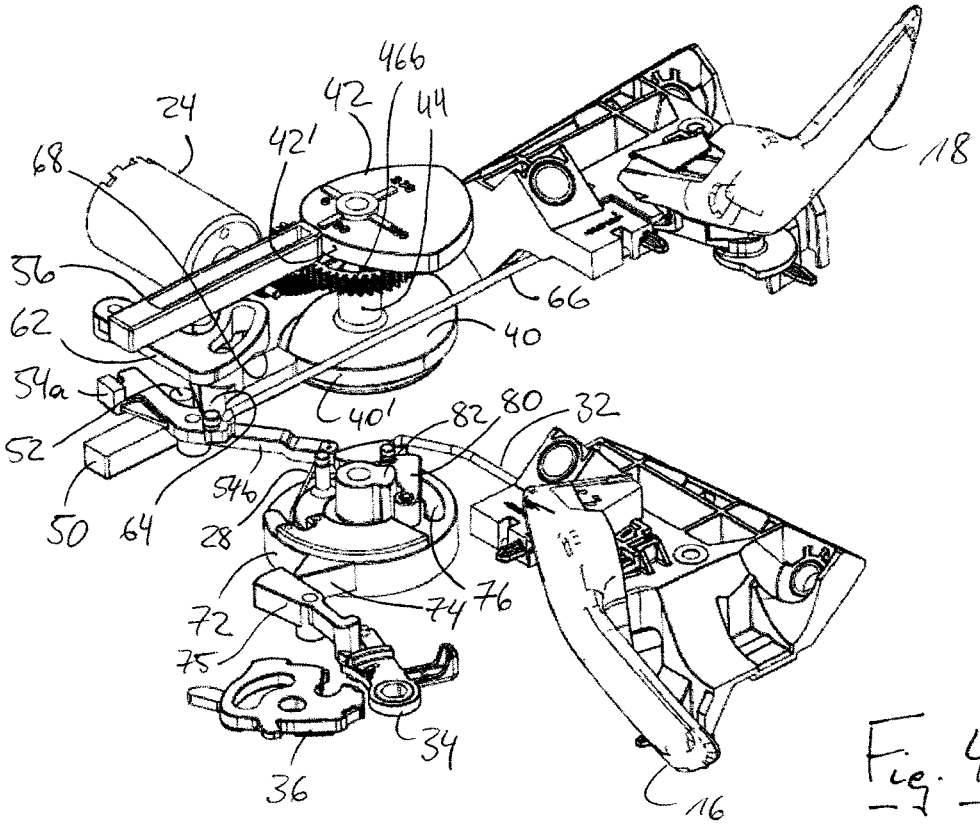
FIG. 4A shows a perspective view of relevant components of the closing system of FIG. 1 in a locked state and with the inner door handle actuated.
Figure 4B:
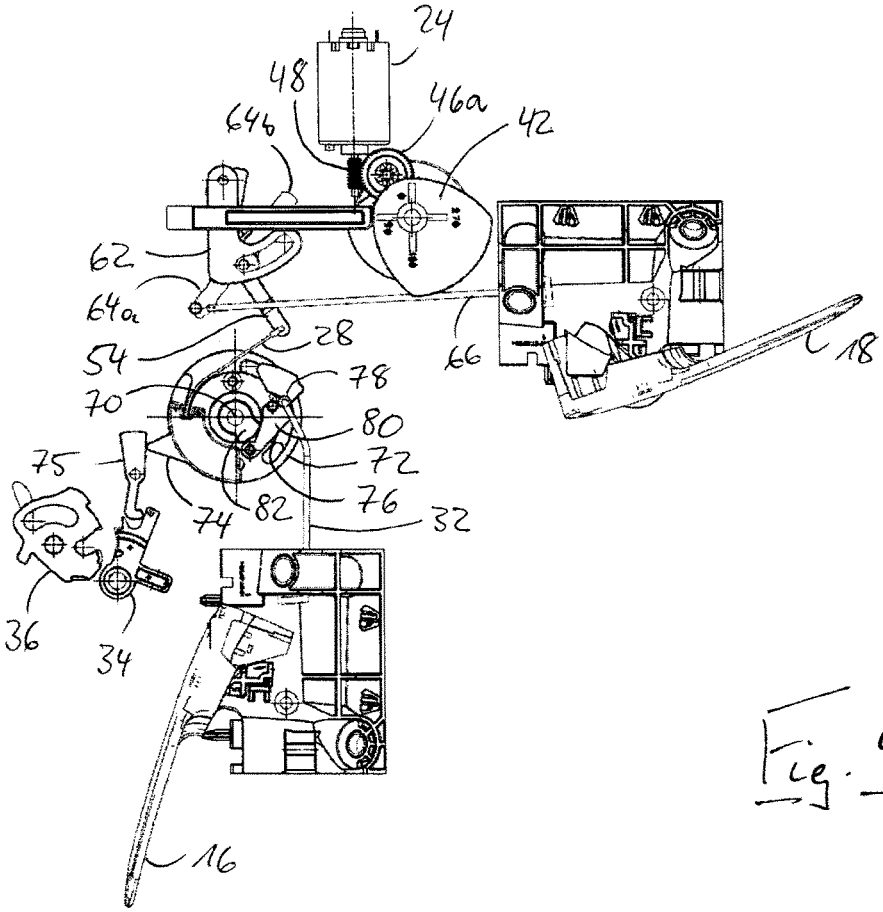
FIG. 4B shows a top view of the components of FIG. 4A.

Specifically, the lifting of the latch 80 causes the Bowden cable head 78 of the second Bowden cable 32 to strike the latch 80 when the inner door handle 16 is actuated, as a result of which the release wheel 72 is further rotated in the opening direction by pulling the second Bowden cable 32 and the projection 74 of the release wheel 72 engages with the release lever 75 and lifts the pawl 34 so that the rotary latch 36 can loosen and the door lock 14 can open (FIG. 4).

Figure 5A:
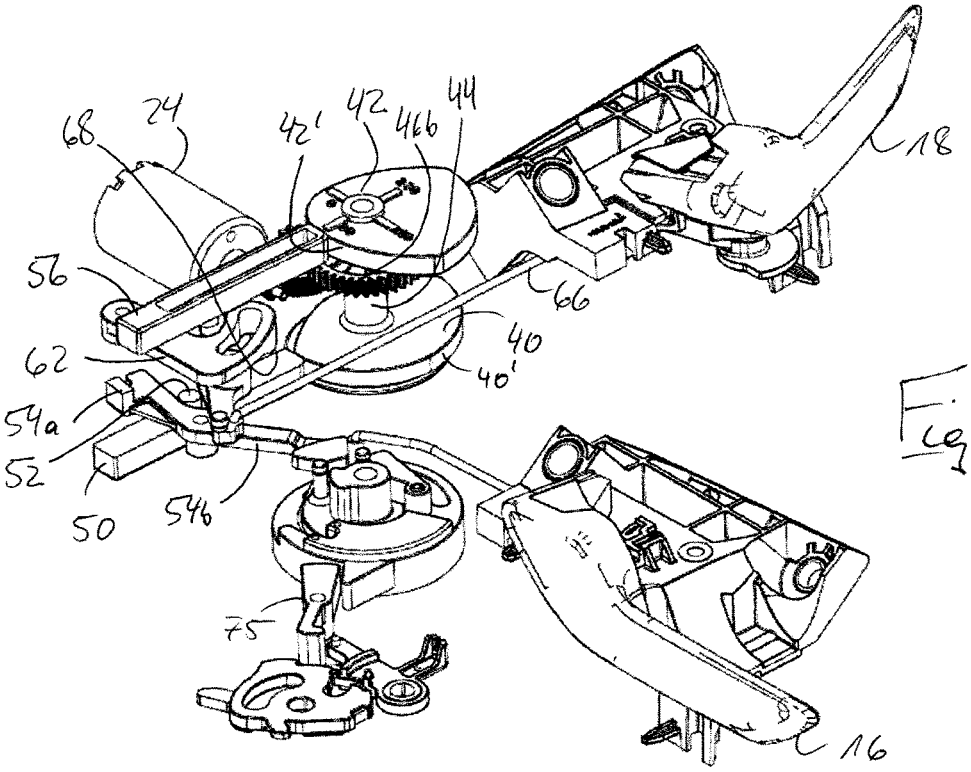
FIG. 5A shows a perspective view of relevant components of the closing system of FIG. 1 in a locked state and with child lock activated.
Figure 5B:
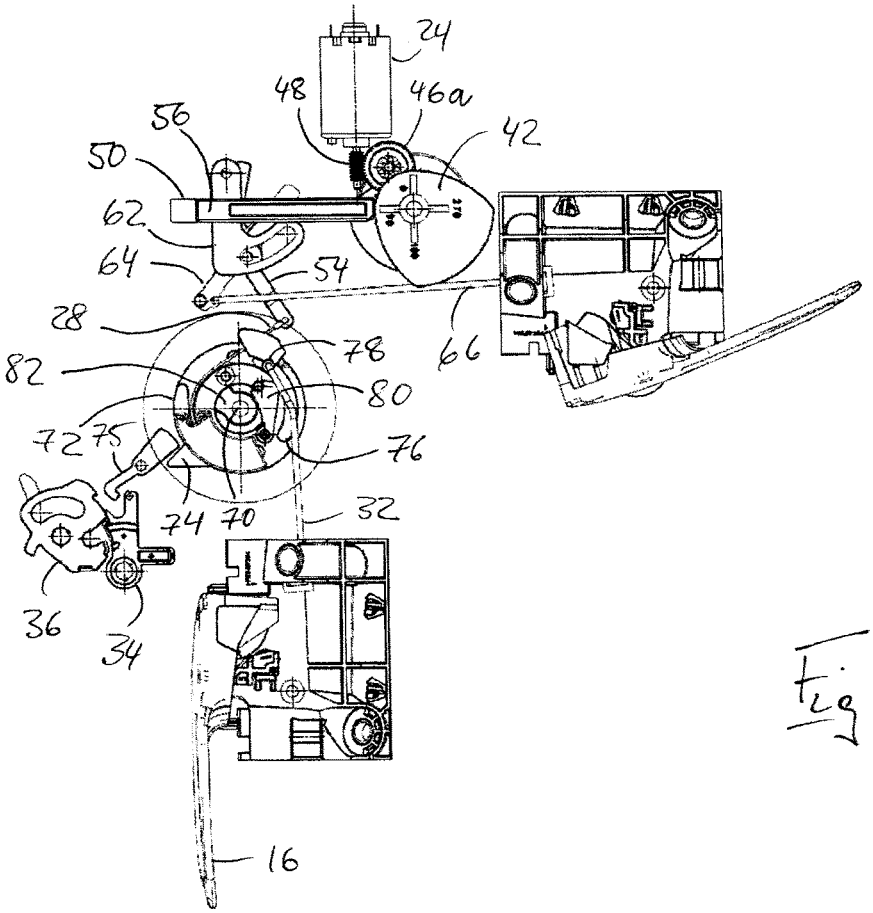
FIG. 5B shows a top view of the components of FIG. 5A.

If, in the locked state of the closing system, opening the door lock 14 by actuating the inner door handle 16 is to be prevented, for example to implement a child lock function, the control cam 82 is adjusted relative to the release wheel 42 in such a way that when the release wheel 72 is rotated into its ready position, the latch 80 is not lifted and consequently the freewheel of the second Bowden cable 32 on the release wheel 72 is not canceled, whereby an actuation of the inner door handle 16 cannot cause the release wheel 72 to rotate, but rather is ineffective (FIG. 5).

If the closing system, which is in the safe state, receives an unlocking signal, for example from a mobile terminal, in particular a remote key or a smartphone, the actuator unit 24 is activated and the control disks 40, 42 are rotated from their 0° position while passing through the locked state described above at 90° by an angle of 180° in total (FIG. 6). The closing system is now in an unlocked state.

The control contour 40' of the first control disk 40 is designed in such a way that when it is rotated from 90° to 180°, there is no further displacement of the first slider 50, so that the first slider 50 and the external actuating lever 54 remain in their ready positions.

The control contour 42' of the second control disk 42, on the other hand, is designed in such a way that the second slider 56 is displaced from its locked position into an unlocked position by rotating the second control disk 42 from 90° to 180°. This displacement of the second slider 56 simultaneously causes the unlocking lever 62 and the outer door handle lever 64 to be rotated into their respective unlocked positions with the additional displacement of the outer door handle lever 64 from the passive plane to the active plane. By rotating the outer door handle lever 64 into its unlocked position, the outer door handle 18 is also extended via the push rod 66.

Figure 7A:
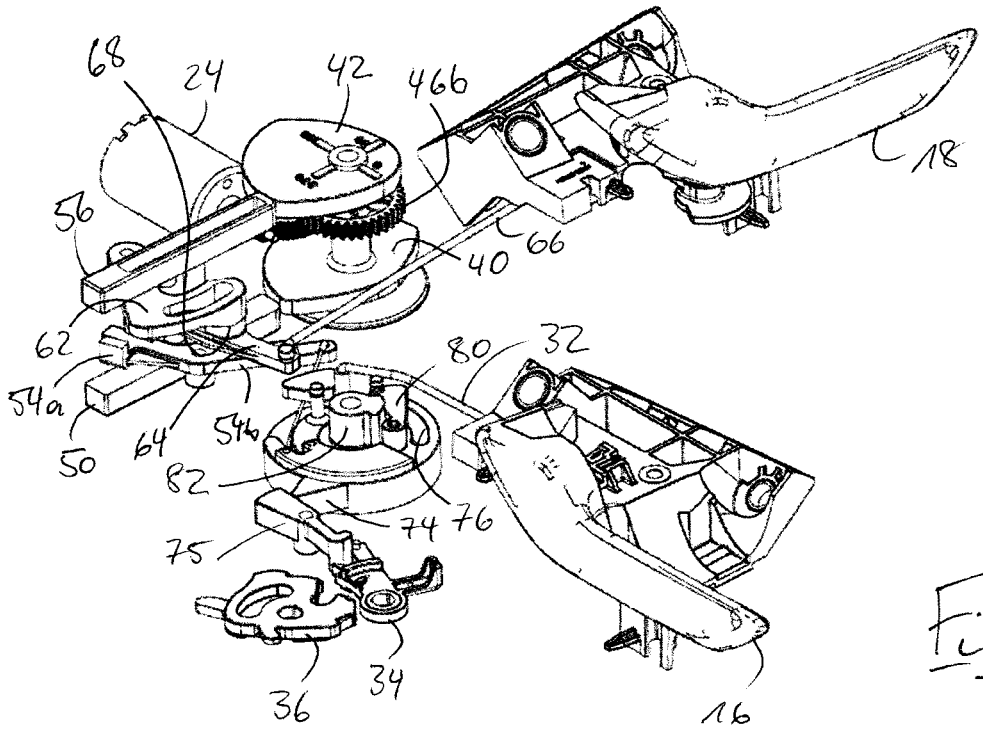
FIG. 7A shows a perspective view of relevant components of the closing system of FIG. 1 at the moment of an electrical opening of the door lock.
Figure 7B:
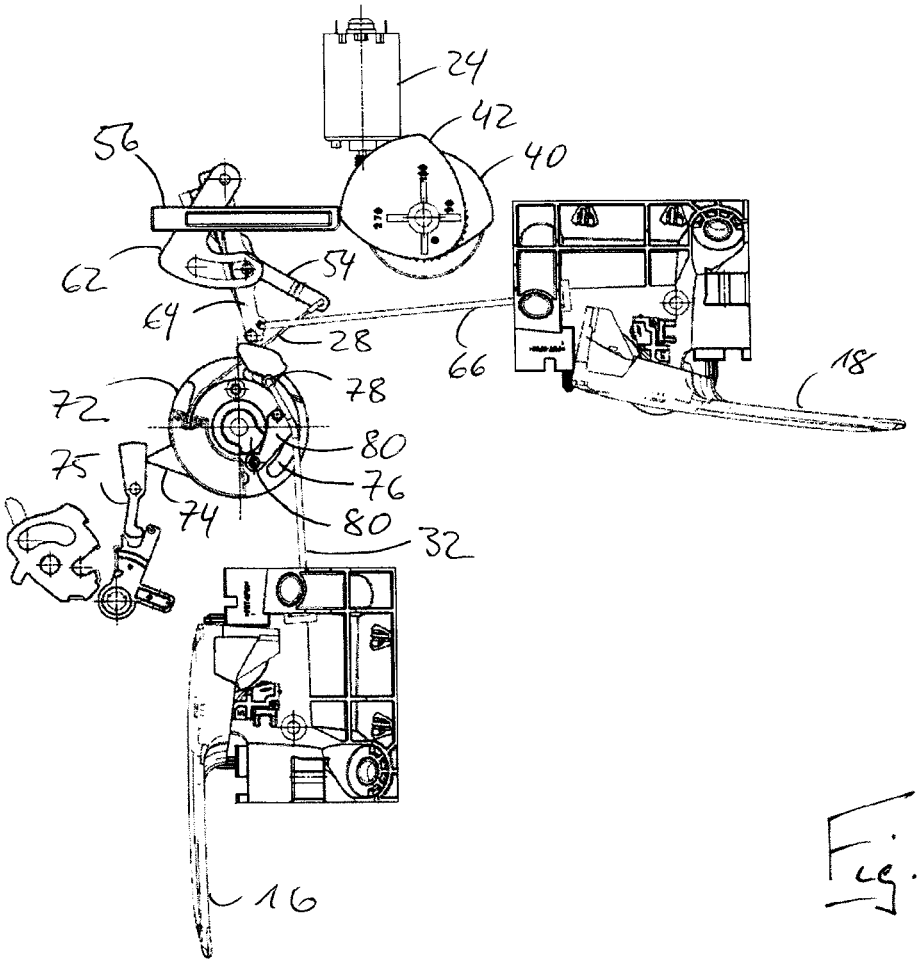
FIG. 7B shows a top view of the components of FIG. 7A.
Figure 8A:
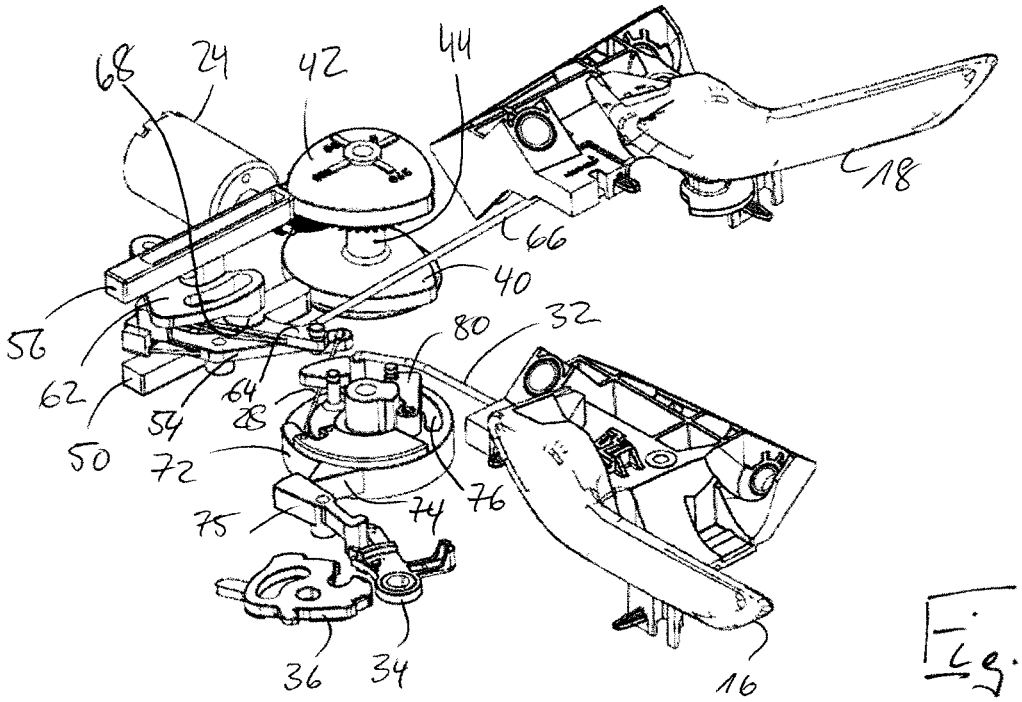
FIG. 8A shows a perspective view of relevant components of the closing system of FIG. 1 in an unlocked state and with the outer door handle actuated.
Figure 8B:
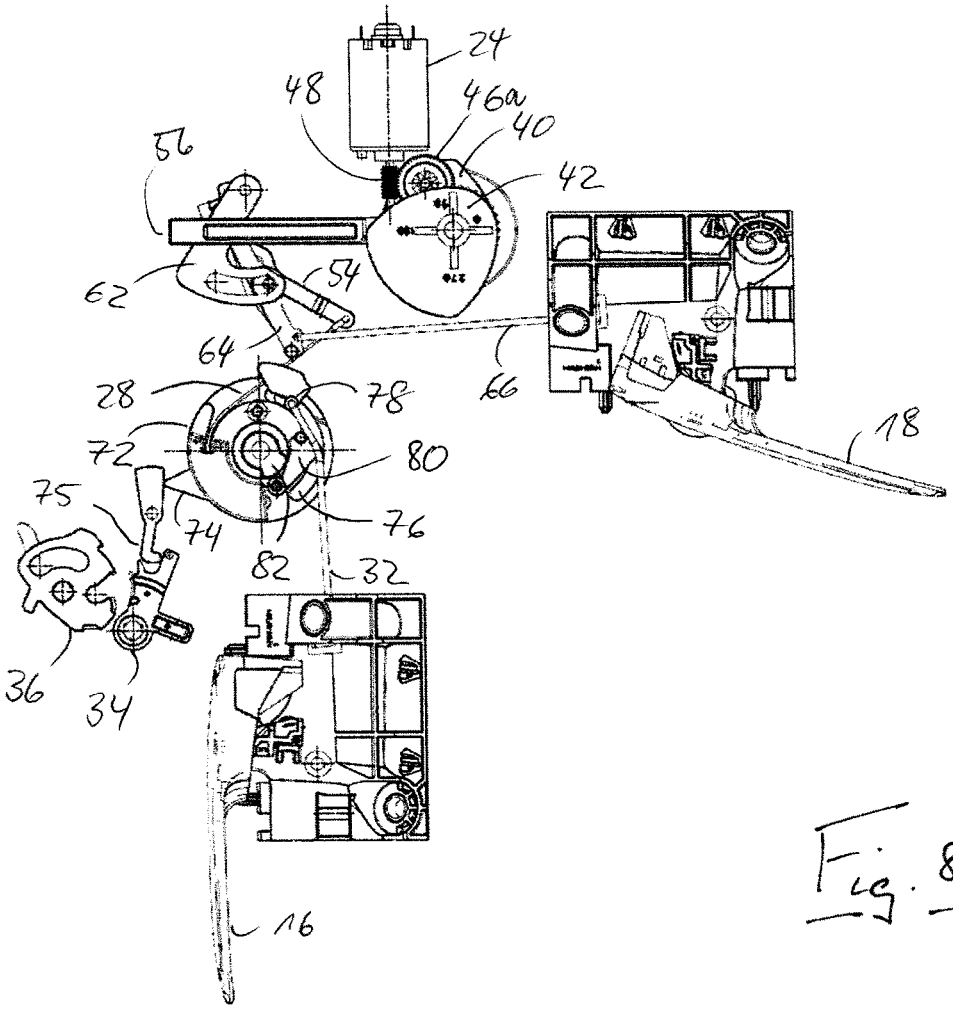
FIG. 8B shows a top view of the components of FIG. 8A.

If the closing system in the unlocked state now receives an opening signal, for example from a sensor arranged on the outer door handle 18, which detects the presence of the vehicle user's hand, or from a mobile terminal, such as a smartphone, the control disks 40, 42 are rotated through a further 90° into a 270° position by corresponding activation of the actuator unit 24 (FIG. 7). The control contour 42' of the second control disk 42 is designed in such a way that the second slider 56 is not moved further during this rotation from 180° to 270°, so that both the unlocking lever 62 and the outer door handle lever 64 each remain in their unlocked positions.

The control contour 40' of the first control disk 40, on the other hand, is designed in such a way that the first slider 50 is displaced from its locked position into its open position by rotating the first control disk 40 from 180° to 270°. By displacing the first slider 50 into the open position, the external actuating lever 54 is also rotated into its open position, and thus tension is exerted on the first Bowden cable 28. The pull on the first Bowden cable 28 causes the release wheel 72, which is already in the ready position, to be rotated further in the opening direction, whereby the projection 74 of the release wheel 72 engages with the release lever of the door lock 14 and rotates it, whereby the pawl 34 is lifted, so that the rotary latch 36 of the door lock 14 can open. In other words, the door lock 14 is opened electrically.

Figure 6A:
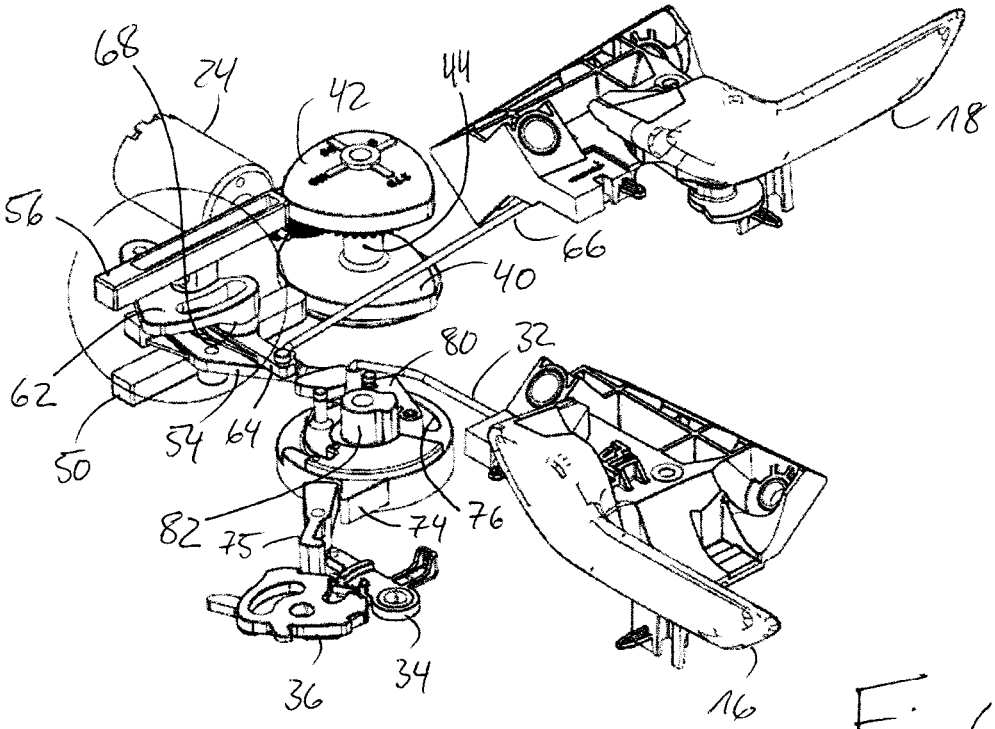
FIG. 6A shows a perspective view of relevant components of the closing system of FIG. 1 in an unlocked state and with the outer door handle extended.
Figure 6B:
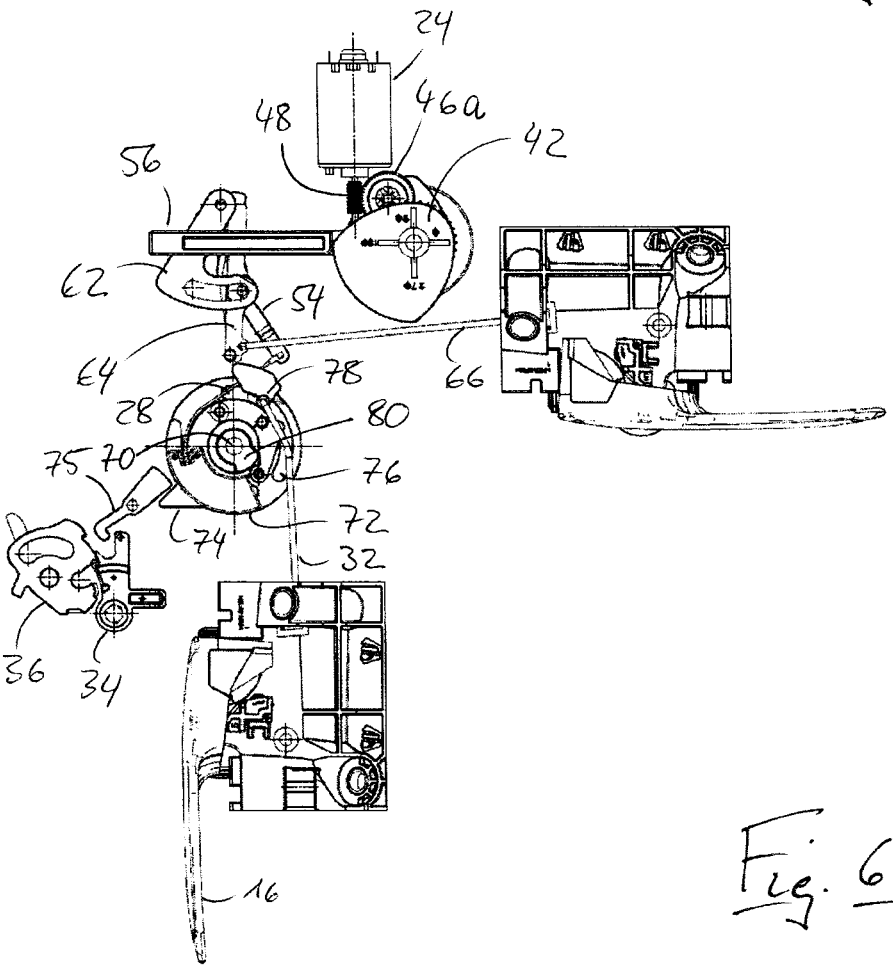
FIG. 6B shows a top view of the components of FIG. 6A.

Alternatively, starting from the unlocked state of the closing system shown in FIG. 6 with control disks 40, 42 in the 180° position, a manual opening of the door lock 14 is also possible (FIG. 8) by a vehicle user, wherein the vehicle user actuates the outer door handle 14 and in this way provides for the rotation of the external actuating lever to the open position 54 via the push rod 66, which is required to rotate the release wheel 72 to lift the pawl 34.

Finally, it should be pointed out that the above-described rotations of the external actuating lever 54, the unlocking lever 62 and the outer door handle lever 64, which are brought about by the actuator unit 24 via the control disks 40, 42 and sliders 50, 56, each take place against a spring force, which, when the direction of rotation of the actuator unit 24 is reversed, ensure that the closing system is reset to the respectively desired closed state. Correspondingly, the manual actuation of the inner door handle 16 and the outer door handle 18 takes place in a conventional manner against a resetting spring force.

LIST OF REFERENCE NUMBERS

12 Door
14 Door lock
16 Inner door handle
18 Outer door handle
20 Bearing bracket
22 Control mechanism
24 Actuator unit
26 Control unit
28 First Bowden cable
30 Clutch
32 Second Bowden cable
34 Pawl
36 Rotary latch
38 Closing cylinder
40 First control disk
40' Control contour
42 Second control disk
42' Control contour
44 Shaft
46*a* Gear wheel
46*b* Gear wheel
48 Worm
50 First slider
52 First driver pin
54 External actuating lever
54*a* First arm
54*b* Second arm
56 Second slider
62 Unlocking lever
64 Outer door handle lever
64*a* First arm
64*b* Second arm
66 Push rod
68 Ramp
70 Axis of rotation
72 Release wheel
74 Projection
75 Release lever
76 Guide link
78 Bowden cable head
80 Latch
82 Control cam

The invention claimed is:

1. Closing system for a door, the closing system comprising:
a door lock;
an inner door handle for opening the door lock;
an outer door handle for opening the door lock;
an actuator unit; and
a control mechanism, which is driven by the actuator unit, wherein, with the aid of the control mechanism driven by the actuator unit, the closing system is configured to:
mechanically decouple the inner door handle and the outer door handle from the door lock;
mechanically decouple the outer door handle only from the door lock;
mechanically decouple the inner door handle only from the door lock;
open the door lock;
mechanically couple the inner door handle and the outer door handle to the door lock;
extend the outer door handle; and
activate a closing aid integrated into the door lock.

2. Closing system according to claim 1, wherein the actuator unit is an electric actuator unit.

3. Closing system according to claim 1, wherein the door lock can be opened mechanically by actuating at least one of the inner door handle and the outer door handle when one of the inner door handle and the outer door handle is coupled to the door lock.

4. Closing system according to claim 1, further comprising a closing cylinder through which the outer door handle can be coupled to the control mechanism or can be decoupled from the control mechanism.

5. Closing system according to claim 1, further comprising a control unit for controlling the control mechanism.

6. Closing system according to claim 5, wherein the control unit has an interface for wireless communication with a mobile terminal.

7. Closing system according to claim 5, wherein the control unit can be controlled by means of an installed app.

8. Closing system according to claim 1, wherein the control mechanism forms a first drive chain for actuating the door lock and a second drive chain for retracting/extending and engaging/disengaging the outer door handle.

9. Closing system according to claim 1, wherein the control mechanism has a first control element which can be driven by the actuator unit and a second control element which can be driven by the actuator unit.

10. Closing system according to claim 9, wherein the first and second control elements can be driven synchronously.

11. Closing system according to claim 9, wherein the first control element interacts with an external actuating element which is connected to a clutch via an actuating means.

12. Closing system according to claim 11,
wherein the first control element is a control disk which interacts with the external actuating element via a first slider or a connecting rod; and
wherein the external actuating element can be brought into three defined positions by the first control element, a ready position and an open position in which a pawl of the door lock is lifted.

13. Closing system according to claim 9, wherein the second control element interacts with a transmission element which is connected to the outer door handle.

14. Closing system according to claim 13,
wherein the second control element is a control disk which interacts with the transmission element via a second slider;
wherein the transmission element can be rotated by the second control element from a first position, in which the outer door handle is retracted, to a second position, in which the outer door handle is extended;
wherein the outer door handle lever is rotated into the second position while an external actuating element is in a ready position; and
wherein the second control element interacts with an unlocking element, which in turn interacts with the transmission element.

15. Closing system according to claim 14,
wherein the transmission element can be brought from a locked position, in which the external actuating element cannot be rotated by the transmission element, into an unlocked position, in which the external actuating element can be rotated by the transmission element, with the aid of the unlocking element;

wherein the transmission element can be brought from a locked position, in which the external actuating element cannot be rotated by the transmission element, into an unlocked position, in which the external actuating element can be rotated by the transmission element, with the aid of the unlocking element and the transmission element assumes its unlocked position when it is rotated into a second position; and wherein the transmission element can be brought from a locked position, in which the external actuating element cannot be rotated by the transmission element, into an unlocked position, in which the external actuating element can be rotated by the transmission element, with the aid of the unlocking element, wherein the transmission element assumes its unlocked position when it is rotated into a second position and the transmission element and the unlocking element are rotated synchronously.

16. Closing system according to claim 1, further comprising a clutch through which the inner door handle can be coupled to or decoupled from the door lock.

17. Closing system according to claim 16, wherein the clutch is arranged in the region of the door lock or is integrated into the door lock;

wherein the clutch can be controlled by the control mechanism;

wherein the control mechanism and the clutch are connected by a first mechanical actuating means; and wherein the inner door handle and the clutch are connected by a second mechanical actuating means.

18. Closing system according to claim 16, wherein the clutch comprises a release wheel which can be engaged one of indirectly by rotating in an opening direction and directly with a pawl of the door lock in order to lift the pawl;

wherein the clutch comprises a release wheel which can be engaged one of indirectly by rotating in an opening direction and directly with a pawl of the door lock in order to lift the pawl, and wherein a first actuating means connecting the clutch and the control mechanism is attached to the release wheel in such a way that a pull on the first actuating means exerted by the control mechanism causes an external actuating element to rotate in the opening direction.

19. Closing system according to claim 18, wherein a second actuating means with a freewheel which connects the clutch and the inner door handle is attached to the release wheel;

wherein a second actuating means with a freewheel which connects the clutch and the inner door handle is attached to the release wheel a latch is rotatably mounted on the release wheel, by means of which the freewheel of the second actuating means can be canceled;

wherein a second actuating means with a freewheel which connects the clutch and the inner door handle is attached to the release wheel a latch is rotatably mounted on the release wheel, by means of which the freewheel of the second actuating means can be canceled, and a rotation of the latch to cancel the freewheel can be brought about by a rotation of the release wheel triggered by the first actuating means relative to which the release wheel is rotated; and wherein a second actuating means with a freewheel which connects the clutch and the inner door handle is attached to the release wheel a latch is rotatably mounted on the release wheel, by means of which the freewheel of the second actuating means can be canceled, and a rotation of the latch to cancel the freewheel can be brought about by a rotation of the release wheel triggered by the first actuating means relative to which the release wheel is rotated and the control cam is adjustable relative to the release wheel to implement a child lock function.

* * * * *